US006745102B1

(12) United States Patent
Liu

(10) Patent No.: US 6,745,102 B1
(45) Date of Patent: Jun. 1, 2004

(54) AUTOMATIC TRANSPORTING SYSTEM AND METHOD FOR OPERATING THE SAME

(75) Inventor: Kuo-Tai Liu, Jubei (TW)

(73) Assignee: Powerchip Semiconductor Corp., Hsin-chu (TW)

( * ) Notice: Subject to any disclaimer, the term of this patent is extended or adjusted under 35 U.S.C. 154(b) by 0 days.

(21) Appl. No.: 10/410,735

(22) Filed: Apr. 10, 2003

(51) Int. Cl.[7] ..... G06F 7/00

(52) U.S. Cl. ..... 700/228; 104/88.01; 104/88.02; 104/88.03; 414/279

(58) Field of Search ..... 700/213, 214, 700/228, 255; 104/88.01, 88.02, 88.03, 89, 91; 198/346.1, 465.1, 465.2, 357, 370.01; 414/279

(56) References Cited

U.S. PATENT DOCUMENTS 3,889,797 A * 6/1975 Naito et al. ..... 198/346.1
3,929,076 A * 12/1975 McRae et al. ..... 104/25
4,831,540 A * 5/1989 Hesser ..... 700/113
5,267,173 A * 11/1993 Tanizawa et al. ..... 700/229
5,551,348 A * 9/1996 Matsumoto ..... 104/88.02
6,591,961 B2 * 7/2003 Fukushima ..... 198/346.2

* cited by examiner

*Primary Examiner*—Khoi H. Tran
(74) *Attorney, Agent, or Firm*—Ladas & Parry

(57) ABSTRACT

An automatic transporting system and a method for operating the same. The automatic transporting system includes a main track, a plurality of transport vehicles, a loading and unloading track, a stocker, a rapid track and an emergency track. The plurality of transport vehicles move on the main track. The loading and unloading track has a first entrance and a first exit. The first entrance and first exit are connected to the main track. The stocker is disposed beside the loading and unloading track. The transport vehicles enter the loading and unloading track and stop at the stocker to load and unload a material. The rapid track has a second entrance and a second exit. The second entrance and second exit are connected to the main track. The emergency track is connected to the main track. The transport vehicles leave the main track via the emergency track.

19 Claims, 2 Drawing Sheets

AUTOMATIC TRANSPORTING SYSTEM AND METHOD FOR OPERATING THE SAME

BACKGROUND OF THE INVENTION

1. Field of the Invention

The present invention relates to an automatic transporting system and method, and in particular to an automatic transporting system and method that enhances the transport efficiency of materials.

2. Description of the Related Art

Generally speaking, a semiconductor factory usually uses over-head shuttles (OHS) or over-head hoists (OHT) to transport wafers.

Referring to FIG. 1, a conventional automatic transporting system 1 includes a transport track 11 and multiple transport vehicles 12, 13, 14 and 15. The transport vehicles 12, 13, 14 and 15 are over-head shuttles (OHS) or over-head hoists (OHT) and loaded with front opening unified pods (foup) 16. Multiple foup stockers 17 and 18 are disposed beside the transport track 11. When the transport vehicles 12, 13, 14 and 15 move to the foup stockers 17 and 18, the foups 16 thereon are transported into the foup stockers 17 and 18. Then, the transport vehicles 12, 13, 14 and 15 continue to move along the transport track 11.

Nevertheless, the conventional automatic transporting system 1 has the following drawbacks. When the transport vehicle 14 moves to the foup stocker 17 to load or unload the foup 16, the transport vehicle 15 behind the transport vehicle 14 has to stop to wait until the transport vehicle 14 has loaded or unloaded the foup 16, thereby causing congestion in the automatic transporting system 1. Furthermore, after the transport vehicle 14 has loaded or unloaded the foup 16, the transport vehicle 14 still has to complete the transport track 11. In addition, when one of the transport vehicles (e.g. transport vehicle 13) malfunctions and stops, other transport vehicles (e.g. transport vehicles 14 and 15) behind the malfunctioned transport vehicle stop as well.

Thus, there is a need to provide an improved automatic transporting system. The improved automatic is transporting system enhances the transport efficiency of the front opening unified pods. Even when one of the transport vehicles malfunctions and stops, the transport of the front opening unified pods and processing of the wafers are not adversely affected.

SUMMARY OF THE INVENTION

Accordingly, an object of the invention is to provide an automatic transporting system. The automatic transporting system comprises a main track, a plurality of transport vehicles, a loading and unloading track, a stocker, a rapid track and an emergency track. The plurality of transport vehicles move on the main track. The loading and unloading track has a first entrance and a first exit. The first entrance and first exit are connected to the main track. The transport vehicles enter the loading and unloading track via the first entrance and enter the main track via the first exit. The stocker is disposed beside the loading and unloading track. The transport vehicles enter the loading and unloading track and stop at the stocker to load and unload a material. The rapid track has a second entrance and a second exit. The second entrance and second exit are connected to the main track. The transport vehicles enter the rapid track via the second entrance and enter the main track via the second exit.

The emergency track is connected to the main track. The transport vehicles leave the main track via the emergency track.

Preferably, the automatic transporting system further comprises a first interlock control device disposed on the connection between the first exit and main track to control the passing sequence of the transport vehicles.

Preferably, the automatic transporting system further comprises a second interlock control device disposed on the connection between the second exit and main track to control the passing sequence of the transport vehicles.

Preferably, the material is a front opening unified pod (foup).

Preferably, the stocker is a foup stocker.

Preferably, the transport vehicles are over-head shuttles (OHS) or over-head hoists (OHT).

Preferably, the automatic transporting system further comprises a robot disposed between the loading and unloading track and the stocker to load the material onto the transport vehicles or unload the material from the transport vehicles.

Another object of the invention is to provide an operation method for the automatic transporting system. The method comprises the steps of: guiding the transport vehicles to the loading and unloading track via the first entrance when the transport vehicles require loading or unloading a material; stopping the transport vehicles at the stocker to load or unload the material; guiding the transport vehicles to the main track via the first exit; guiding the transport vehicles to the rapid track via the second entrance to save the transit time thereof; guiding the transport vehicles to the main track via the second exit; and guiding the transport vehicles to the emergency track to leave the main track when the transport vehicles malfunction.

Preferably, the operation method further comprises a step of: using a robot to load the material onto the transport vehicles or unload the material from the transport vehicles.

Preferably, the robot is disposed between the loading and unloading track and the stocker.

Preferably, the operation method further comprises a step of: using a first interlock control device to control the passing sequence of the transport vehicles entering the main track via the first exit and moving on the main track.

Preferably, the first interlock control device is disposed on the connection between the first exit and main track.

Preferably, the operation method further comprises a step of: using a second interlock control device to control the passing sequence of the transport vehicles entering the main track via the second exit and moving on the main track.

Preferably, the second interlock control device is disposed on the connection between the second exit and main track.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
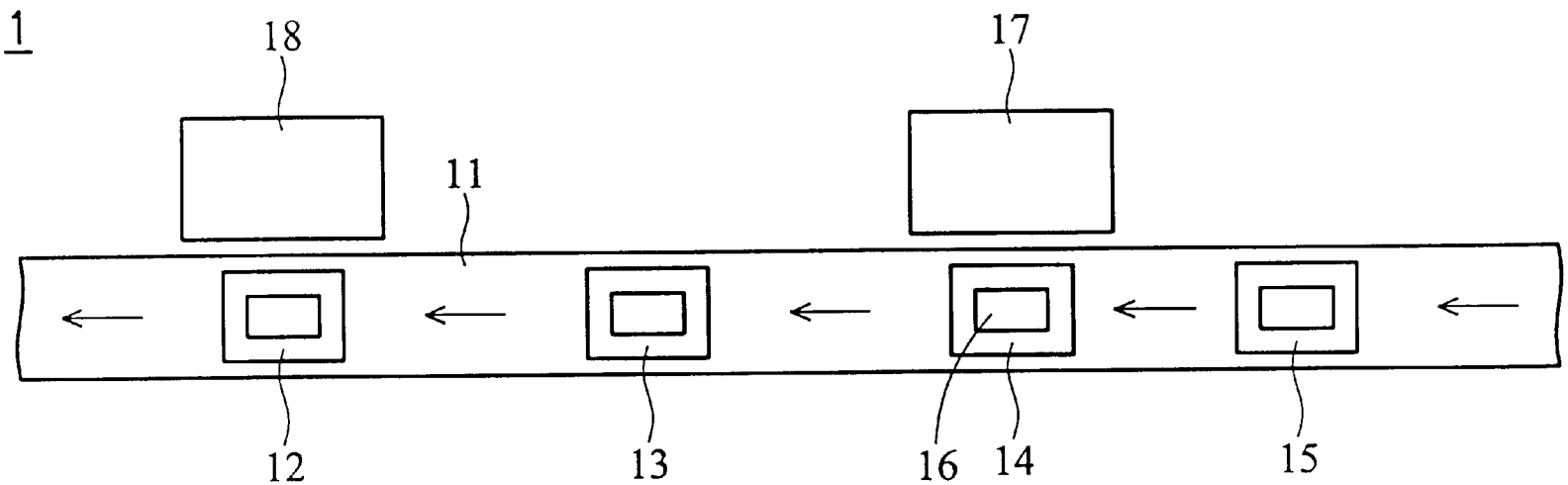
FIG. 1 (PRIOR ART)
FIG. 1 is a schematic view showing a conventional automatic transporting system.
Figure 2:
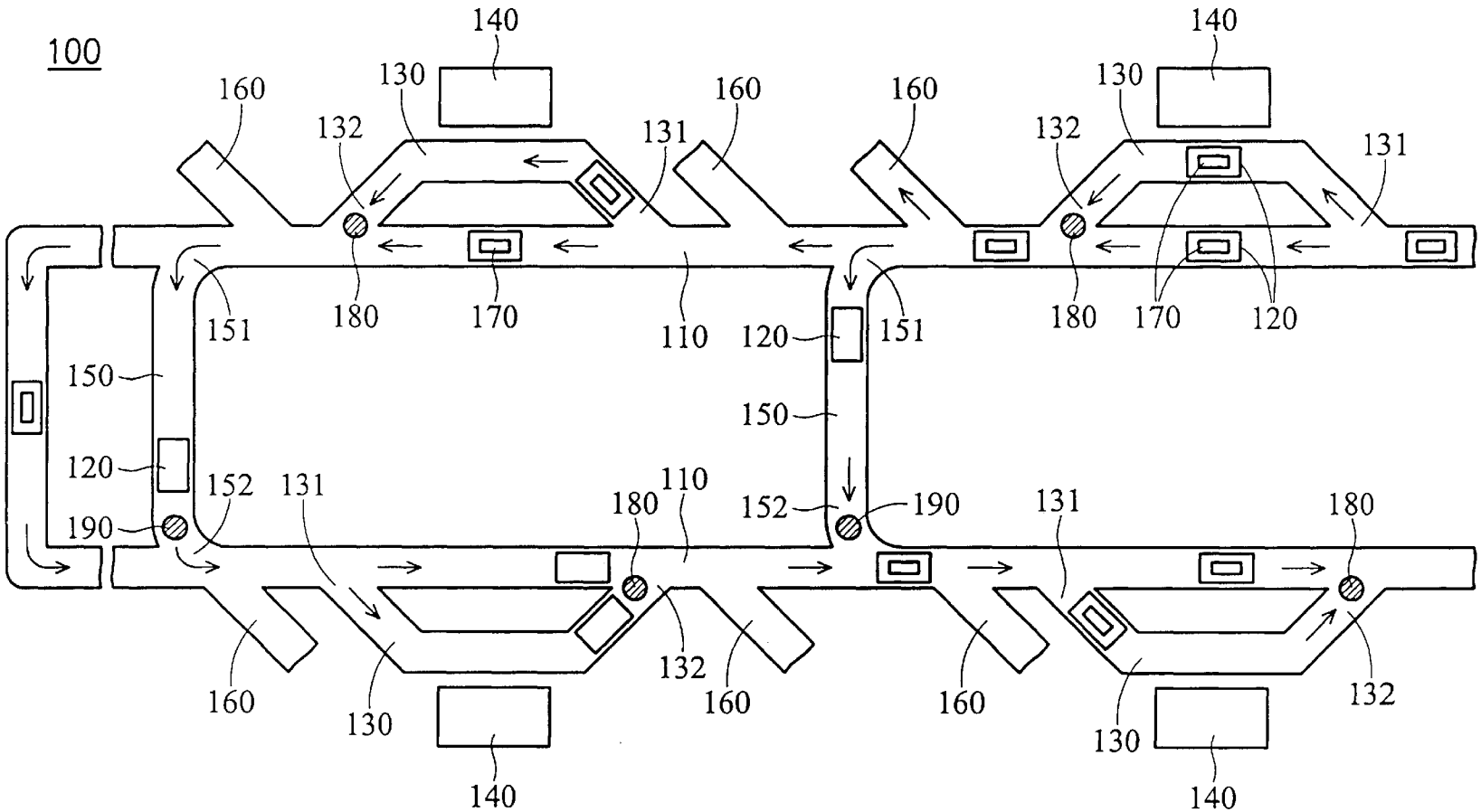
FIG. 2 is a schematic view showing the automatic transporting system of the invention.

Referring to FIG. 2, the automatic transporting system 100 comprises a main track 110, a plurality of transport vehicles 120, a plurality of loading and unloading tracks 130, a plurality of stockers 140, a plurality of rapid tracks 150 and a plurality of emergency tracks 160. Each loading and unloading track 130 has a first entrance 131 and a first exit 132. The first entrance 131 and first exit 132 are connected to the main track 110. The stockers 140 are disposed beside the loading and unloading track 130. Each rapid track 150 has a second entrance 151 and a second exit 152. The second entrance 151 and second exit 152 are connected to the main track 110. The emergency tracks 160 are connected to the main track 110. Specifically, the emergency tracks 160 can be connected to any part of the main track 110.

The transport vehicles 120 may be over-head shuttles (OHS) or over-head hoists (OHT). Each transport vehicle 120 carries a front opening unified pod (foup) 170. Wafers (not shown) are placed in the foups 170. The stockers 140 are foup stockers.

As shown in FIG. 2, the transport vehicles 120 initially move on the main track 110. When one of the transport vehicles 120 needs to load or unload a foup 170 at the stocker 140, the transport vehicle 120 enters the loading and unloading track 130 via the first entrance 131 and the other vehicles continue to move along the main track 110. Thus, congestion and waiting time of the transport vehicles 120 is prevented. Meanwhile, when the transport vehicle 120 stops at the stocker 140, the foup 170 on the transport vehicle 120 is unloaded by a robot (not shown). Then, the unloaded transport vehicle 120 can enter the main track 110 again via the first exit 132.

Because the foup 170 has been unloaded, it is not necessary for the unloaded transport vehicle 120 to continue moving along the main track 110. Thus, the unloaded transport vehicle 120 can enter the rapid track 150 via the second entrance 151 and further enter the main track 110 via the second exit 152 to return to the departure point of the main track 110. Accordingly, since the plurality of rapid tracks 150 are connected to the main track 110, any unloaded transport vehicle 120 can return to the departure point of the main track 110 via the nearest rapid track 150. The unloaded transport vehicle 120 at the departure point of the main track 110 can be loaded with another foup 170 to perform next transport, thereby reducing the processing time of the wafers.

In addition, as shown in FIG. 2, when any of the transport vehicles 120 malfunctions and cannot move, the malfunctioned transport vehicle 120 is guided to the is nearest emergency track 160 to be repaired. Thus, the overall transport of the automatic transporting system 100 is not adversely affected.

Specifically, as shown in FIG. 2, a first interlock control device 180 is disposed on the connection between the first exit 132 of the loading and unloading track 130 and the main track 110 to control the passing sequence of the transport vehicles 120. Namely, when the unloaded transport vehicle 120 enters the main track 110 via the first exit 132 of the loading and unloading track 130, there may be another transport vehicle 120 moving on the main track 110 passing the connection between the first exit 132 and main track 110. Thus, when unloaded and other transport vehicles 120 arrive at the connection, the first interlock control device 180 can analyze and decide which transport vehicle 120 should pass the connection first, such that collisions between unloaded and other transport vehicles 120 are prevented.

Similarly, a second interlock control device 190 is disposed on the connection between the second exit 152 of s the rapid track 150 and the main track 110 to control the passing sequence of the transport vehicles 120. Namely, when one of the unloaded transport vehicles 120 enters the main track 110 via the second exit 152 of the rapid track 150, there may be another transport vehicle 120 moving on the main track 110 passing the connection between the second exit 152 and main track 110. Thus, when the two transport vehicles 120 arrive at the connection, the second interlock control device 190 can analyze and decide which transport vehicle 120 should pass the connection first, such that a collision between the two transport vehicles 120 is prevented.

In conclusion, the automatic transporting system 100 has the following advantages.

(1) The transport efficiency of the wafers (materials) is increased and the processing time thereof is reduced.

(2) The impact of malfunctioning transport vehicles is greatly reduced, such that the overall manipulation of the automatic transporting system 100 is not adversely affected.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An automatic transporting system, comprising:

a main track;

a plurality of transport vehicles moving on the main track;

a loading and unloading track having a first entrance and a first exit, wherein the first entrance and first exit are connected to the main track, and the transport vehicles enter the loading and unloading track via the first entrance and enter the main track via the first exit;

a stocker disposed beside the loading and unloading track, wherein the transport vehicles enter the loading and unloading track and stop at the stocker to load and unload a material;

a rapid track having a second entrance and a second exit, wherein the second entrance and second exit are connected to the main track, and the transport vehicles enter the rapid track via the second entrance and enter the main track via the second exit; and an emergency track connected to the main track, wherein the transport vehicles leave the main track via the emergency track.

2. The automatic transporting system as claimed in claim 1, further comprising a first interlock control device disposed on the connection between the first exit and main track to control the passing sequence of the transport vehicles.

3. The automatic transporting system as claimed in claim 1, further comprising a second interlock control device disposed on the connection between the second exit and main track to control the passing sequence of the transport vehicles.

4. The automatic transporting system as claimed in claim 1, wherein the material is a front opening unified pod (foup).

5. The automatic transporting system as claimed in claim 1, wherein the stocker is a foup stocker.

6. The automatic transporting system as claimed in claim 1, wherein the transport vehicles are over-head shuttles (OHS).

7. The automatic transporting system as claimed in claim 1, wherein the transport vehicles are over-head hoists (OHT).

8. The automatic transporting system as claimed in claim 1, further comprising a robot disposed between the loading and unloading track and the stocker to load the material onto the transport vehicles or unload the material from the transport vehicles.

9. An operation method for an automatic transporting system having a main track, a plurality of transport vehicles, a loading and unloading track, a stocker, a rapid track and an emergency track, the transport vehicles moving on the main track, the loading and unloading track having a first entrance and a first exit, the first entrance and first exit connected to the main track, the stocker disposed beside the loading and unloading track, the rapid track having a second entrance and a second exit, the second entrance and second exit connected to the main track, and the emergency track connected to the main track, comprising the steps of:

guiding the transport vehicles to the loading and unloading track via the first entrance when the transport vehicles require loading or unloading a material;

stopping the transport vehicles at the stocker to load or unload the material;

guiding the transport vehicles to the main track via the first exit;

guiding the transport vehicles to the rapid track via the second entrance to reduce the transit time thereof;

guiding the transport vehicles to the main track via the second exit; and guiding the transport vehicles to the emergency track to leave the main track when transport vehicles malfunction.

10. The operation method as claimed in claim 9, further comprising a step of:

using a robot to load the material onto the transport vehicles or unload the material from the transport vehicles.

11. The operation method as claimed in claim 10, wherein the robot is disposed between the loading and unloading track and the stocker.

12. The operation method as claimed in claim 9, further comprising a step of:

using a first interlock control device to control the passing sequence of the transport vehicles entering the main track via the first exit and moving on the main track.

13. The operation method as claimed in claim 12, wherein the first interlock control device is disposed on the connection between the first exit and main track.

14. The operation method as claimed in claim 9, further comprising a step of:

using a second interlock control device to control the passing sequence of the transport vehicles entering the main track via the second exit and moving on the main track.

15. The operation method as claimed in claim 14, wherein the second interlock control device is disposed on the connection between the second exit and main track.

16. The operation method as claimed in claim 9, wherein the material is a front opening unified pod (foup).

17. The operation method as claimed in claim 9, wherein the stocker is a foup stocker.

18. The operation method as claimed in claim 9, wherein the transport vehicles are over-head shuttles (OHS).

19. The operation method as claimed in claim 9, wherein the transport vehicles are over-head hoists (OHT).

* * * * *